United States Patent [19]

Schneider

[11] 4,230,760

[45] Oct. 28, 1980

[54] FOIL WEB FOR FILLING AUTOMATS WITH A REMOVAL APPARATUS

[76] Inventor: Eugene Schneider, Romerstr. 4, 6701 Altrip, Fed. Rep. of Germany

[21] Appl. No.: 901,568

[22] Filed: May 1, 1978

[30] Foreign Application Priority Data

Apr. 30, 1977 [DE] Fed. Rep. of Germany ..... 2719450

[51] Int. Cl.[2] ..... B32B 3/02; B32B 7/14; B05D 5/00

[52] U.S. Cl. ..... 428/195; 427/286; 428/206; 428/207; 428/210; 428/426; 428/441

[58] Field of Search ..... 428/209, 195, 206, 207, 428/210, 426, 441, 500; 427/286

[56] References Cited

U.S. PATENT DOCUMENTS

| | | | |
|---|---|---|---|
| 3,510,388 | 5/1970 | Hunt et al. | 428/209 |
| 3,638,608 | 2/1972 | Gabbard | 427/286 |
| 3,694,945 | 10/1972 | Detiker | 428/209 X |
| 3,945,495 | 3/1976 | Carmody et al. | 428/195 X |
| 3,947,614 | 3/1976 | Becker | 428/209 X |

*Primary Examiner*—Thomas J. Herbert, Jr.
*Attorney, Agent, or Firm*—Kinzer, Plyer, Dorn & McEachran

[57] ABSTRACT

Plastic bagging foil having surfaces of rough pigment applied thereto in spaced parallel strips located between welded seams.

3 Claims, 3 Drawing Figures

FOIL WEB FOR FILLING AUTOMATS WITH A REMOVAL APPARATUS

Figure 1:
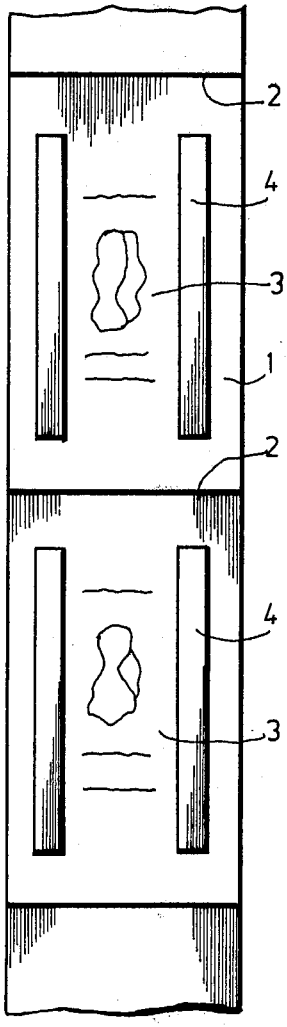

The invention relates to a foil web for filling automats machines comprising a removal apparatus, with removal belts or rollers located on both sides of the web.

Such foils consisting particularly of polyethylene are used for producing wrapping bags for the most diverse products, whereby they are loaded in the automats. Among others, filling automats are used in this connection which comprise, as removal apparatus, removal belts or rollers arranged on both sides of the foil web. Since the cost of the foil material should be as low as possible, considerable fluctuations in quality can be noticed, whereby particularly the surface of these foils is extremely smooth. Due to these fluctuations in quality the foils frequently have too high a share of lubricants and thus become greasy. Within the scope of the removal belts or rollers this will cause the removal belts or rollers to become smooth, soapy and slippery within a few days, and thus a continuous conveying of the foil within the scope of the filling automats is no longer assured. Since it is the task of the removal belts and/or the removal rollers to remove the adjusted bag length, the bag length actually reached becomes too short by the slip between belt and/or roller and foil, so that the bag filled with the material to be expended becomes jammed between the welding jaws and thus the punching knives and the welding jaws will be damaged. Then rather long shutdown times are required to restore the operative condition of the apparatus, and each time the greasy deposits must be removed from the belts and the remainder of the machine must be cleaned to remove discharged merchandise. It has been shown thereby in the art that for cleaning the removal belts or rolls at least every five to ten minutes shutdown time must be reckoned with.

The invention is based on the problem of so designing a foil for such filling automats that a conveyance is assured without slip through the dispensing apparatus of the machine.

This problem is solved according to the invention in that a layer of material is applied strip-like, commensurate with the position of the removal belts or rollers on the web, the surface of said layer being blunt (rough).

An advantageous embodiment is characterized by the fact that the layer is regularly discontinuous or of different length within the bag length from welding seam to welding seam.

The layer of material advantageously consists of a pigmented varnish.

The invention offers the important advantage that the foil material used can be processed perfectly, whereby fluctuations as to quality in the foil material can be disregarded. Down times for cleaning the filling apparatus at regular intervals are eliminated, and the removal length for the bags to be filled can be maintained accurately. The stripe-like layer of material which provides the surface with the necessary roughness can be imprinted advantageously together with the label identifying the contents of the bag.

The invention shall be explained more in detail below in the following specification by way of embodiments.

Figure 2:
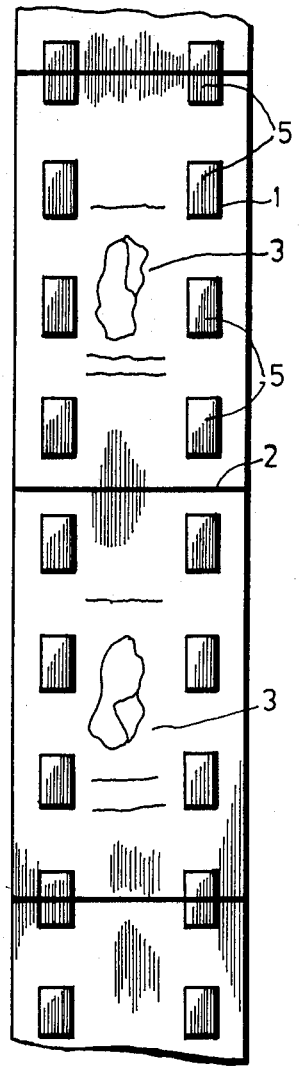
Figure 3:
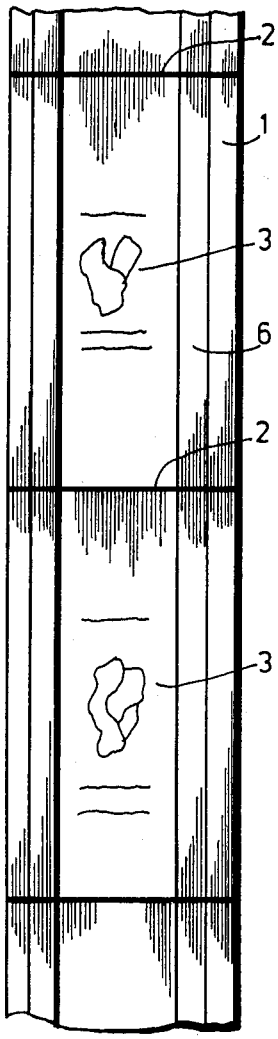

FIGS. 1 to 3 show a view from the top on the foil web with lateral strips of different design.

In FIGS. 1 to 3, No. 1 identifies in each case the foil web, whereby welding seams 2 extending transversely over the foil web 1 limit the bag length. A corresponding label 3 can be imprinted for identification of the contents of the bag.

Layers of material 4,5,6 are applied on both sides of the foil web 1 stripe-like, whereby the surface of these material layers is blunt and thus has a certain roughness. It is appropriate to use for this purpose a lacquer or varnish, that is a pigmented varnish which is applied together with the impression of the label. Such a varnish may have, for example, the following composition:

1. As solvent a denatured alcohol, share 0.700 parts;
2. pigments in the form of finest quartz meal W 2000, share 0.100 parts;
3. as agglutinate mono-styrene. Share: 0.200 parts.

The spacing of these stripes 4 and/or 5 and/or 6 as well as their width is adjusted to the removal belts and/or rollers used in filling automats. However, the width of the strips 4,5,6 will be selected as narrowly as possible in order to save on material.

In the embodiment according to FIG. 1 the stripes 4 are discontinuous ahead of each welding seam 2, in the embodiment according to FIG. 2 the discontinuance is accomplished at regular intervals, while in the embodiment according to FIG. 3 continuous stripes 6 are used.

I claim:

1. A wrapping bag foil web to be used in a filling machine in association with removal rollers or belts juxtaposed to at least one of the sides of the web, said foil having applied thereto narrow spaced parallel stripes of pigmented material parallel to the longitudinal edges of the web, to impart thereto spaced roughened non-slip surfaces commensurate with the position of the rollers or belts.

2. A wrapping bag foil web according to claim 1 in which the foil has welded seams at spaced intervals to define a bag length, with said stripes being discontinuous and extending between the welded seams in a repeating pattern.

3. A foil web according to claim 1 or 2 in which the pigmented material comprises fine quartz pigment and an agglutinate in a solvent.

* * * * *